US006204646B1

(12) United States Patent
Hiramatsu et al.

(10) Patent No.: US 6,204,646 B1
(45) Date of Patent: Mar. 20, 2001

(54) POWER SUPPLY DEVICE

(75) Inventors: Yoshihisa Hiramatsu; Kou Takemura; Yoshiyuki Hojo; Nobuhiro Nishikawa, all of Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 0 days.

(21) Appl. No.: 09/593,035

(22) Filed: Jun. 13, 2000

(30) Foreign Application Priority Data

Jun. 15, 1999 (JP) ..... 11-167713

(51) Int. Cl.[7] ..... G05F 1/40; G05F 1/56
(52) U.S. Cl. ..... 323/273; 323/282
(58) Field of Search ..... 323/266, 269, 323/271, 273, 275–277, 282, 285

(56) References Cited

U.S. PATENT DOCUMENTS 4,061,962 * 12/1977 Stewart ..... 323/273
6,100,675 * 8/2000 Sudo ..... 323/282
6,127,814 * 10/2000 Goder ..... 323/282

* cited by examiner

*Primary Examiner*—Matthew Nguyen
(74) *Attorney, Agent, or Firm*—Arent Fox Kintner Plotkin & Kahn, PLLC

(57) ABSTRACT

A power supply device that feeds electric power to an output terminal that is to be connected to a load has first and second PNP-type transistors having their emitters connected to a supplied power line. The collector of the first transistor is connected to the output terminal, and is connected also through two serially connected resistors to ground. An operational amplifier controls the first and second transistors in such a way that the voltage at the node between the two serially connected resistors is kept equal to a setting voltage. To achieve this, a control current is fed to the bases of the first and second transistors. In accordance with the collector current of the second transistor, a limiter circuit limits the output current of the first transistor. The limiter circuit controls the first transistor through the operational amplifier. Between the collectors of the first and second transistors, a capacitor is connected. This capacitor keeps the collector voltage of the second transistor high so as to make the limiter circuit operate when the power supply device is started up or the load is short-circuited.

7 Claims, 6 Drawing Sheets

POWER SUPPLY DEVICE

BACKGROUND OF THE INVENTION

1. Field of the Invention

The present invention relates to a power supply device for supplying electric power to a load.

2. Description of the Prior Art

FIG. 6 shows a circuit diagram of a conventional power supply device. In this figure, reference numeral 1 represents an operational amplifier, reference numeral 2 represents an output transistor composed of a PNP-type transistor, reference numerals 3 and 4 represent resistors, reference numeral 5 represents an output current detection transistor composed of a PNP-type transistor, and reference numeral 60 represents an output current control signal generating circuit that, only when the value of the current fed to its input terminal "i" is higher than a predetermined value, outputs from its output terminal "o" an output current control signal S, which is a signal that varies according to the value of the current fed in.

Here, if it is assumed that the ratio of the emitter area of the output transistor 2 to that of the output current detection transistor 5 is N: 1, and that the two transistors have identical collector-emitter voltages and identical base currents, then the ratio of the current flowing through the output transistor 2 (hereafter referred to as the "output current") $I_O$ to the current flowing through the output current detection transistor 5 (hereafter referred to as the "detected current") $I_K$ is N: 1 (where 1<N).

This power supply device has its constituent circuit elements interconnected as follows. The output transistor 2 has its base connected to the output terminal of the operational amplifier 1, has its emitter connected to a direct-current supplied power line L having a voltage $V_{CC}$, and has its collector grounded through two resistors 3 and 4 connected in series. The output current detection transistor 5 has its base connected to the output terminal of the operational amplifier 1, and has its emitter connected to the supplied power line L. The collector current of the output current detection transistor 5, i.e. the detected current $I_K$, is fed to the terminal "i" of the output current control signal generating circuit 60.

The operational amplifier 1 receives a setting voltage $V_{REF}$ at its inverting input terminal (−), and its non-inverting input terminal (+) is connected to the node A between the two resistors 3 and 4 connected in series. The node B between the collector of the output transistor 2 and the resistor 3 is connected to an output terminal OUT. To the output terminal OUT, a load 100 is connected.

The operational amplifier 1 also has an output current adjustment terminal T, and is so configured as to limit the output current in accordance with a signal fed to this output current adjustment terminal T. More specifically, here, the operational amplifier 1 is so configured that, as the value of the signal fed to the output current adjustment terminal T becomes higher, the output current is limited more, and, as the value of the signal fed to the output current adjustment terminal T becomes lower, the output current is limited less. To the output current adjustment terminal T of the operational amplifier 1, the output current control signal S is fed that is output from the terminal "o" of the output current control signal generating circuit 60. The output current control signal S is a current that flows from the terminal T through the transistor Q3 to ground.

The output current control signal generating circuit 60 is configured as follows. The input terminal "i" is connected to one end of a resistor R, and also to the base of an NPN-type transistor Q. The other end of the resistor R is connected to ground. The transistor Q has its emitter connected to ground, and has its collector connected to the terminal "o".

In this output current control signal generating circuit 60 configured as described above, when the value of the current fed in (i.e. the current flowing through the resistor R) is lower than a predetermined value, the transistor Q remains off, and thus the value of the output current control signal S is zero. By contrast, when the value of the current fed in is higher than the predetermined value, the higher the value of the current fed in, the higher the value of the output current control signal S and, the lower the value of the current fed in, the lower the value of the output current control signal S.

In this circuit configuration, the output current $I_O$ is converted by the resistors 3 and 4 into a voltage that is fed out via the output terminal OUT, and the voltage at the node A between the resistors 3 and 4 is used as the setting voltage $V_{REF}$. In addition, a current limiter circuit, constituted by the operational amplifier 1, the output current detection transistor 5, and the output current control signal generating circuit 60, operates in such a way that, when the value of the output current $I_O$ becomes higher than a predetermined value, the higher the value of the output current $I_O$, the more difficult it becomes for the base current $I_B$ of the output transistor 2 to flow, and thus the tighter the limit on the value of the output current $I_O$ becomes.

However, in this conventional power supply device, the value of the output current $I_O$ is limited irrespective of the output voltage (the voltage at the output terminal OUT), and therefore, when the output voltage is zero volts, an amount of electric power corresponding to the output current $I_O$ multiplied by the supplied voltage $V_{CC}$ is dissipated in the output transistor 2, and the resulting heat may lead to thermal runaway.

Moreover, in some cases, together with a load 100 to which to supply electric power, a capacitor for preventing oscillation may be connected to the output terminal OUT, or even a capacitance may be present in the load 100 itself. In such cases, when the power supply device is started up, a large output current flows to charge such capacitances (hereafter, such an output current will be referred to as an "inrush current").

In the conventional power supply device described above, the current limiter circuit mentioned above operates to reduce an inrush current, but only with a limited effect. It is to be noted that a large inrush current causes a fluctuation in the voltage $V_{CC}$ on the supplied voltage line L, which may lead to malfunctioning of other circuits connected to the supplied voltage line L.

To sum up, this conventional power supply device tends to incur a large inrush current, and is thus likely to adversely affect other circuits that are connected to the common supplied power line L.

SUMMARY OF THE INVENTION

An object of the present invention is to provide a power supply device that is less likely to adversely affect other circuits connected to a common supplied power line.

To achieve the above object, according to one aspect of the present invention, a power supply device is provided with: an output terminal; output means for supplying an output current to a load connected to the output terminal; output voltage detection means for detecting the output voltage at the output terminal; output control means for controlling the output means in accordance with the result of detection by the output voltage detection means so as to keep the output voltage at a predetermined value; first means for outputting a monitoring current that varies in an identical manner with the output current; second means for feeding, when the value of the monitoring current output from the first means is higher than a predetermined value, an output current control signal to the output control means in order to instruct the output control means to reduce the value of the output current in such a way that, the higher the value of the monitoring current, the lower the value of the output current; and a capacitive element connected between the input terminal of the second means and the output terminal.

In this circuit configuration, when the power supply device is started up, the voltage obtained by detecting the output current and converting it into a voltage rises more sharply than in a conventional power supply device. This makes it possible to recognize an extremely large output current and set an accordingly tight limit on the output current.

According to another aspect of the present invention, a power supply device is provided with: an output terminal to which a load is connected; a first transistor having a first electrode thereof connected to a direct-current supplied voltage and having a second electrode thereof connected to the output terminal; a second transistor having a first electrode thereof connected to the direct-current supplied voltage; at least two resistors connected in series between the second electrode of the first transistor and a fixed voltage; an amplifier receiving at a first input terminal thereof a setting voltage, receiving at a second input terminal thereof the voltage at the node between the at least two resistors, having an output terminal thereof connected to control electrodes of the first and second transistors, and controlling the first and second transistors in such a way as to keep the voltage at the node equal to the setting voltage; a limiter circuit connected to a second electrode of the second transistor so that, in accordance with the current fed from the second electrode of the second transistor, the limiter controls, through the amplifier, the output current of the first transistor; and a capacitor connected between the second electrodes of the first and second transistors.

BRIEF DESCRIPTION OF THE DRAWINGS

This and other objects and features of the present invention will become clear from the following description, taken in conjunction with the preferred embodiments with reference to the accompanying drawings in which.

DESCRIPTION OF THE PREFERRED EMBODIMENTS

Hereinafter, embodiments of the present invention will be described with reference to the accompanying drawings.

Figure 1:
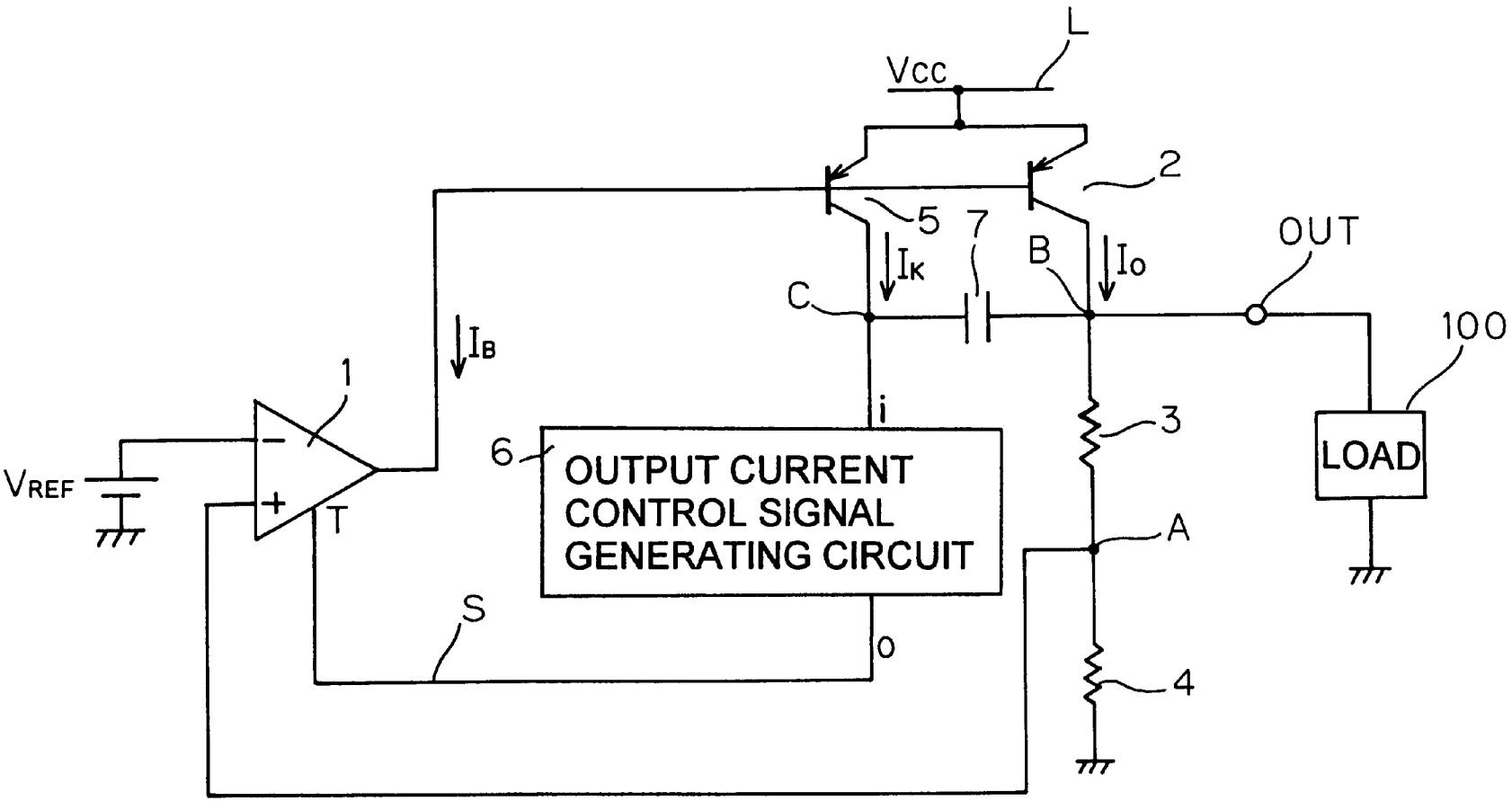
FIG. 1 is a circuit diagram of a power supply device embodying the invention.
Figure 6:
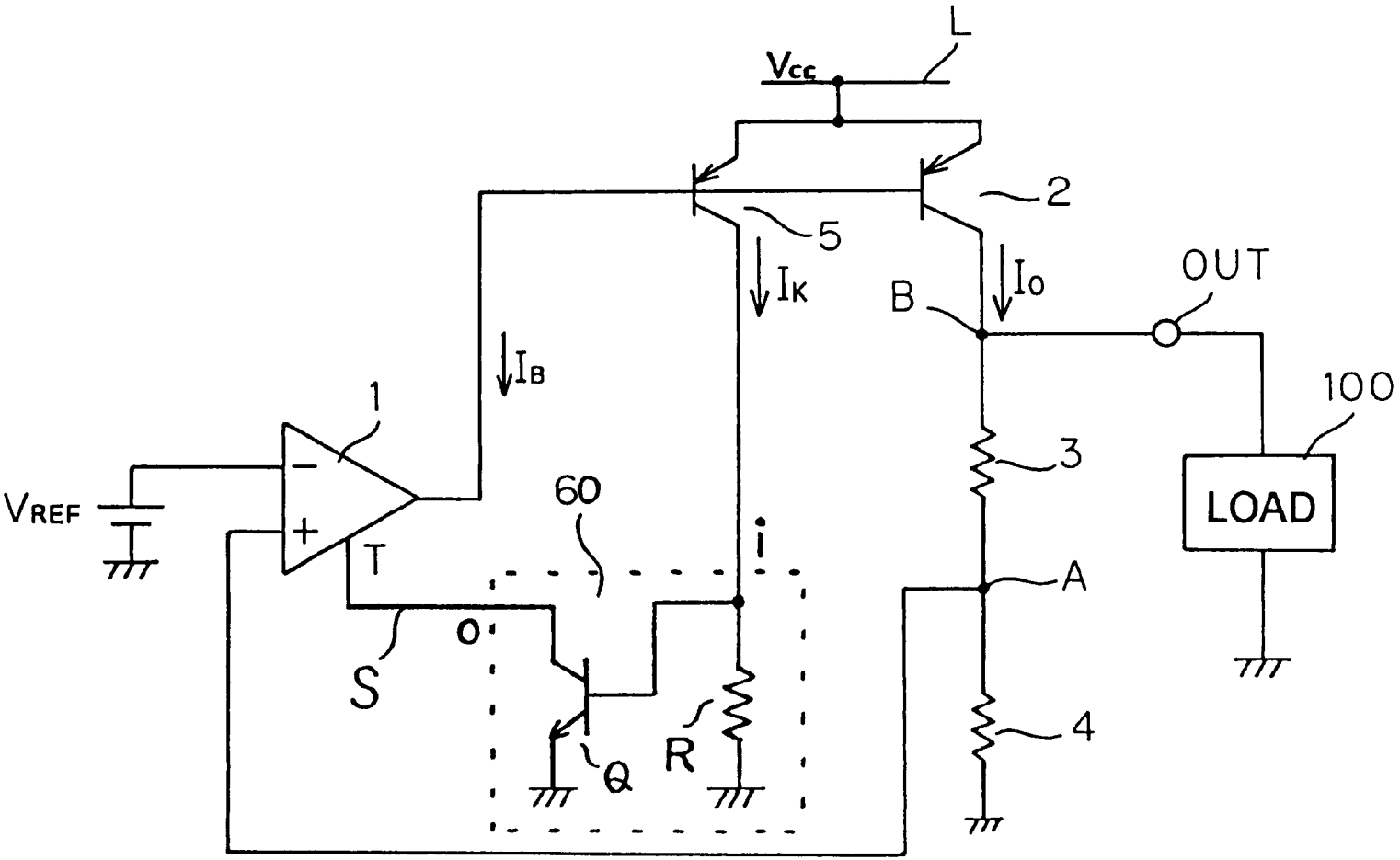
FIG. 6 PRIOR ART
FIG. 6 is a circuit diagram of a conventional power supply device.

FIG. 1 shows a circuit diagram of a power supply device embodying the invention. In this figure, reference numeral 6 represents an output current control signal generating circuit, and reference numeral 7 represents a capacitor. Here, such circuit elements as are found also in the power supply device shown in FIG. 6 as prior art are identified with the same reference numerals, and their descriptions will not be repeated.

The output current control signal generating circuit 6 has the same function as the output current control signal 60 mentioned earlier in the description of the prior-art power supply device. The capacitor 7 is connected at one end to the node B between the collector of the output transistor 2 and the resistor 3 and at the other end to the node C between the collector of the output current detection transistor 5 and the input terminal "i" of the output current control signal generating circuit 6; that is, the capacitor 7 is connected between the output terminal OUT of the power supply device and the input terminal "i" of the output current control signal generating circuit 6. In other words, the capacitor 7 is connected between the collectors of the transistors 2 and 5.

Figure 2:
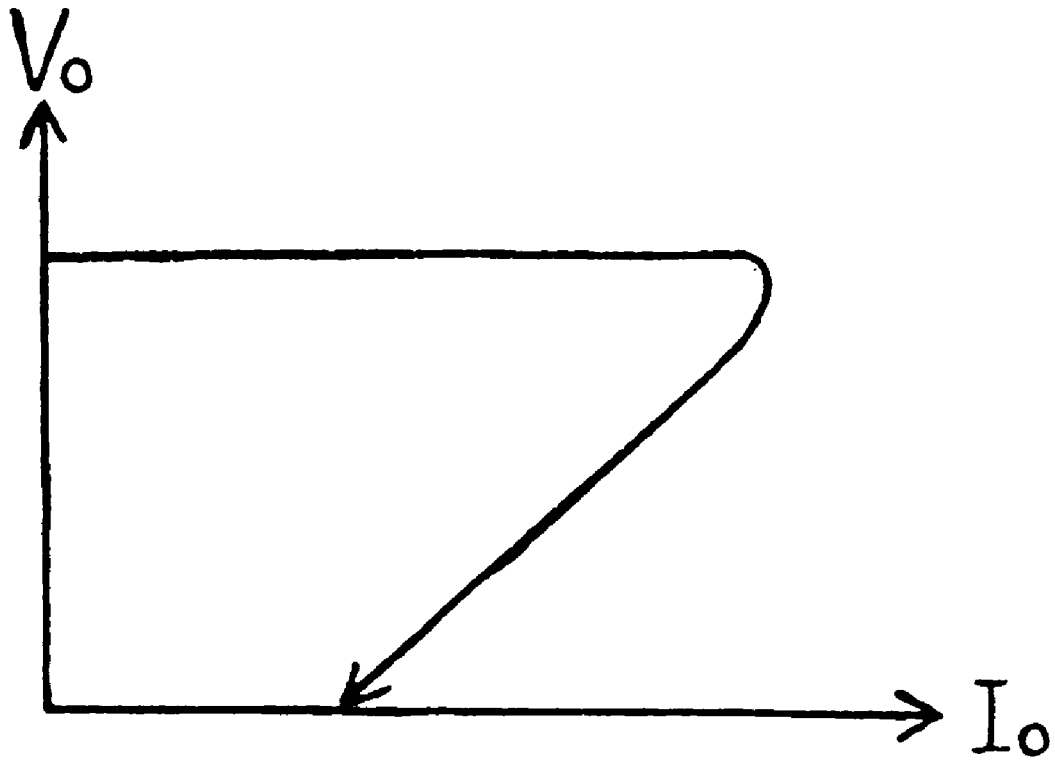
FIG. 2 is a diagram showing the relationship between the output voltage and the output current in a power supply device embodying the invention.

In this circuit configuration, when the power supply device is started up, the voltage at the node C rises at the same time that the output voltage rises. This is recognized as indicating that a larger current is fed to the output current control signal generating circuit 6, and therefore a tighter limit is set on the output current $I_O$. In this way, it is possible, irrespective of the state of the load 100 (i.e. how resistive it is to a current fed thereto) to make more difficult for the output current to flow at start-up, and thereby reduce an inrush current more effectively. This helps alleviate the variation of the voltage $V_{CC}$ on the supplied power line L due to an inrush current, and thereby prevent other circuits connected to the common supplied power line L from being affected adversely. In addition, it is also possible to reduce the risk of the output transistor 2 being heated up to the point of yielding to thermal runaway. Here, when the output current $I_O$ becomes higher than a predetermined value, the output current 10 is limited, so that the output voltage $V_O$ and the output current $I_O$ exhibit a relationship as shown in FIG. 2. Similarly, even when the load 100 is accidentally short-circuited, the capacitor 7 exerts its current limiting effect. Specifically, when the load 10 is short-circuited, the voltage at the output terminal OUT drops to zero volts. However, at this time, the collector current of the transistor 5 flows from the node C through the capacitor 7 to the output terminal OUT, and thereby charges the capacitor 7. As a result, the voltage at the node C rises. Now that the voltage at the node C has risen, the power supply device operates exactly as it does at start-up as described above, and thus the output current $I_O$ is limited.

Figure 3:
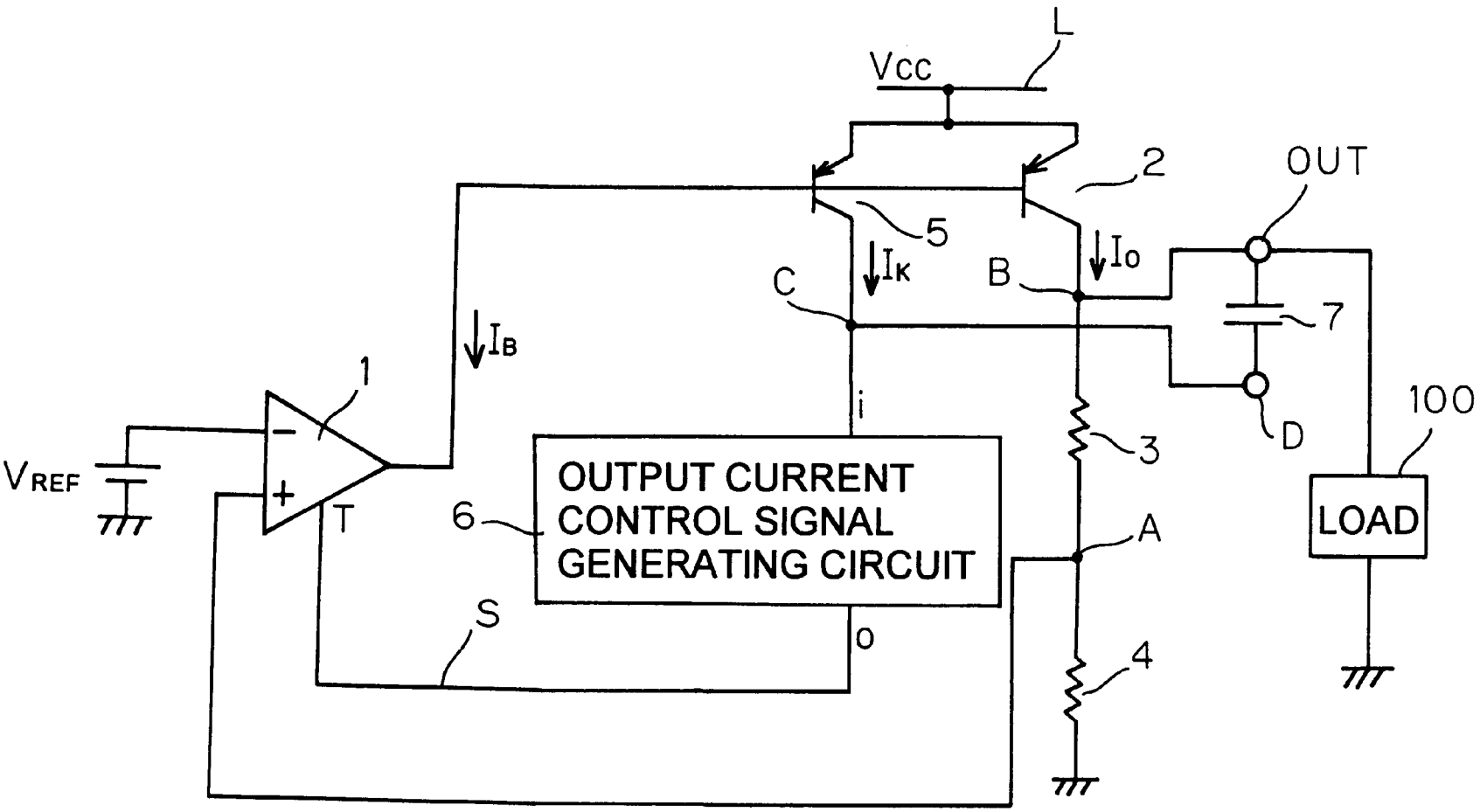
FIG. 3 is a circuit diagram of another power supply device embodying the invention.

This power supply device may be configured as shown in FIG. 3. Here, the input terminal "i" of the output current control signal generating circuit 6 is diverted to a terminal D for external connection, and the capacitor 7 is connected between the terminal OUT and the terminal D, so that the capacitor 7 is provided outside the power supply device (hereafter referred to as "externally" provided). This helps promote miniaturization of the power supply device, and also makes alteration of its specifications easier.

Figure 4:
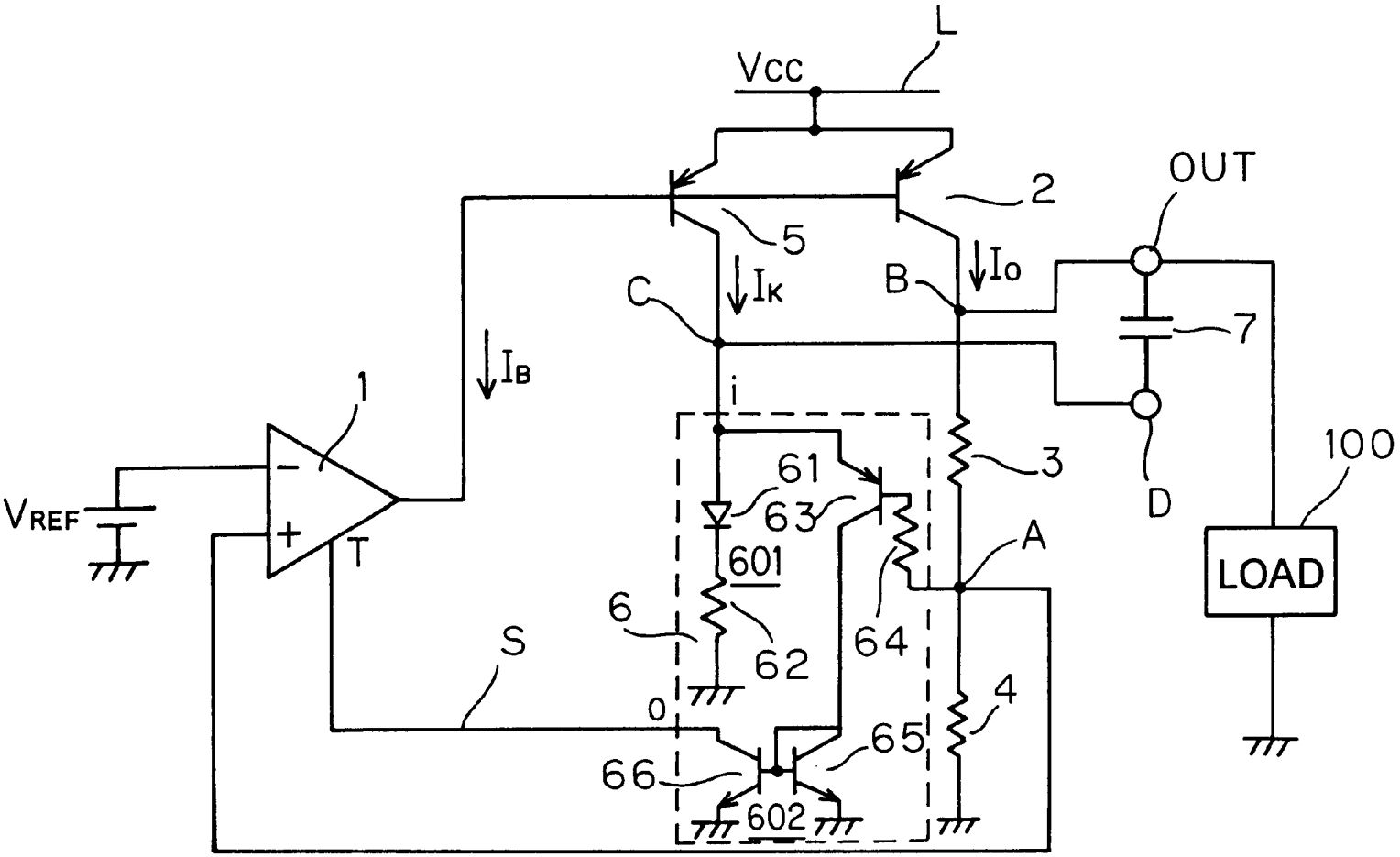
FIG. 4 is a circuit diagram of the power supply device shown in FIG. 1, with the circuit configuration of the output current control signal generating circuit shown specifically.

FIG. 4 shows a circuit diagram of the power supply device shown in FIG. 3, with the circuit configuration of the output current control signal generating circuit 6 shown specifically. In this figure, reference numeral 61 represents a diode, reference numeral 62 represents a resistor, reference numeral 63 represents a judgment transistor composed of a PNP-type transistor, reference numeral 64 represents a resistor, and reference numerals 65 and 66 represent NPN-type transistors. The diode 61 has its anode connected to the input terminal "i", and has its cathode connected to one end of the resistor 62, of which the other end is grounded. The diode 61 and the resistor 62 together constitute a current-to-voltage conversion circuit 601.

The judgment transistor 63 has its emitter connected to the anode of the diode 61, has its base connected through the resistor 64 to the node A between the resistors 3 and 4, and has its collector connected to the collector of the transistor 65.

The transistors 65 and 66 constitute a current mirror circuit 602 of a current inflow type, with the transistors 65 and 66 placed in the input and output sides, respectively, thereof. The collector of the input-side transistor 65 is, as described above, connected to the collector of the judgment transistor 63, and the collector of the output-side transistor 66 is connected to the output current adjustment terminal T of the operational amplifier.

In this circuit configuration, the current fed to the input terminal "i" of the output current control signal generating circuit 6 is converted into a voltage by the current-to-voltage conversion circuit 601. When the voltage thus obtained by conversion becomes higher than a predetermined voltage (specifically, a voltage higher than the voltage at the node A by the threshold voltage of the judgment transistor 63), the judgment transistor 63 is turned on. Then, the current mirror circuit 602 causes a current having the same value as the collector current of the judgment transistor 63 to flow out of the current adjustment terminal T of the operational amplifier 1. Accordingly, when the value of the current fed to the input terminal "i" becomes higher than the predetermined value, the higher the value of that current, the higher the current that flows out of the current adjustment terminal T of the operational amplifier 1.

The resistor 64 connected to the base of the judgment transistor 63 makes it difficult for the judgment transistor 63 to be saturated even when the base voltage thereof lowers, and thus serves to reduce the risk of malfunctioning of the output current control signal generating circuit 6.

In addition, the output current control signal S is extracted by mirroring the collector current of the judgment transistor 63 through the current mirror circuit 602. This helps suppress an increase in gain within the output current control signal generating circuit 6, and thus serves to reduce the risk of the output current control signal generating circuit 6 starting to oscillate.

Moreover, the use of the diode 61 makes it possible to cancel the temperature-dependent variation of the threshold voltage of the judgment transistor 63 with the temperature-dependent variation of the forward voltage of the diode 61, and thus serves to reduce the temperature-dependent variation of the value to which the output current is limited.

Figure 5:
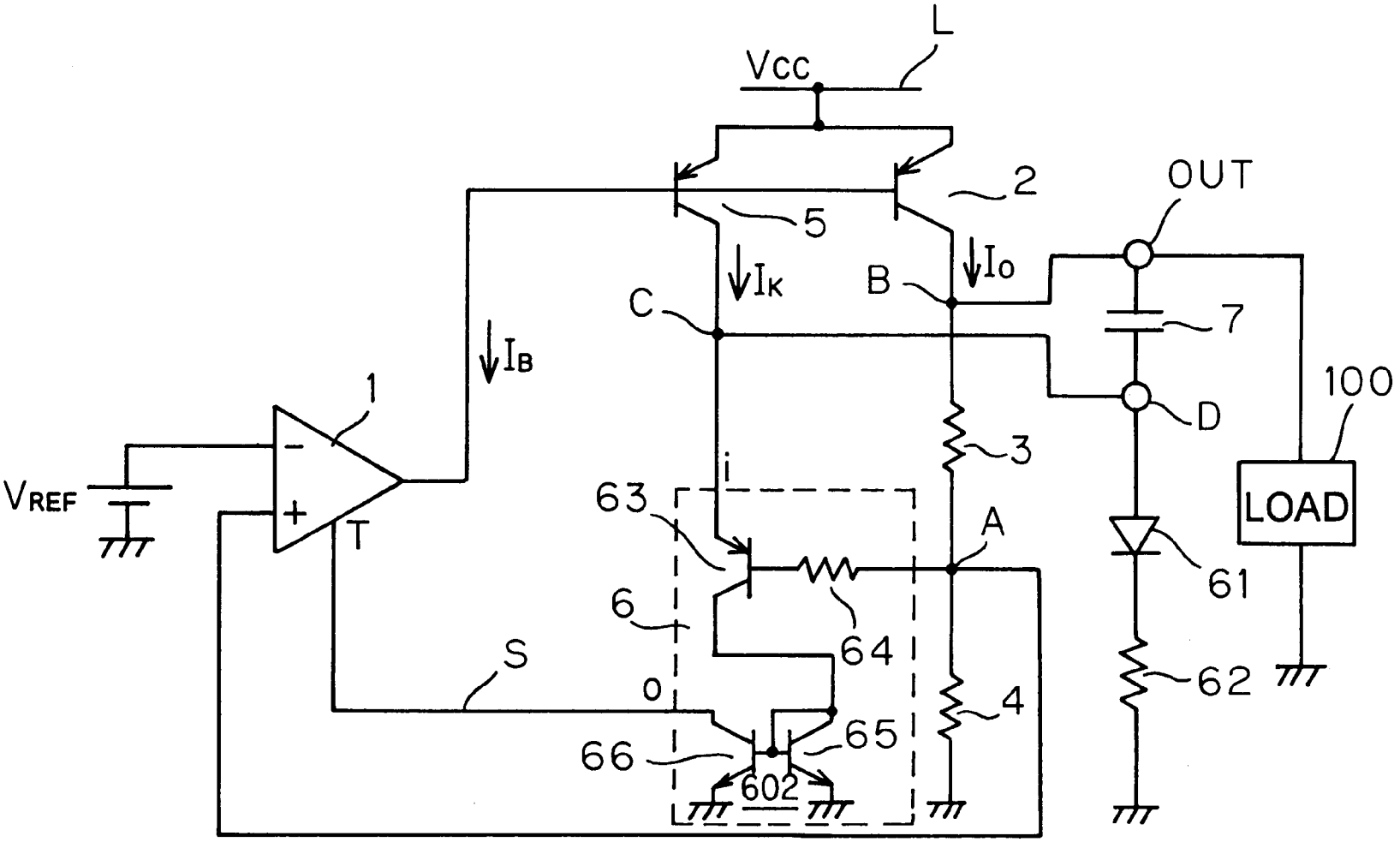
FIG. 5 is a circuit diagram of the power supply device shown in FIG. 3, with the current-to-voltage circuit provided externally.

As shown in FIG. 5, the diode 61 and the resistor 62 constituting the current-to-voltage conversion circuit 601 may be connected to the terminal D so that the diode 61 and the resistor 62 are connected externally. This makes it easier to change the value to which the output current is limited, and thus makes it possible to feed electric power to various loads that require the current supplied thereto to be limited to different values.

It is preferable to use as the diode 61 a diode that exhibits as little temperature-dependent variation of the forward voltage as possible and use as the judgment transistor 63 a transistor of which the temperature-dependent variation of the threshold voltage can be ignored. This helps reduce the temperature-dependent variation of the value to which the output current is limited. It is also possible to permit only one of the diode 61 and the resistor 62 (i.e. not both) to be connected externally.

In the embodiments described above, a PNP-type transistor is used as the output transistor; however, it is also possible to use an NPN-type transistor as the output transistor. It is also possible to permit a voltage to be fed in from the outside and apply the voltage thus fed in to the base of the judgment transistor 63 through the resistor 64, or to connect, in any other manner, the base of the judgment transistor 63 through the resistor 64 to a point having a predetermined voltage. It is to be understood that, in this way, the invention may be practiced in various manners other than specifically presented above as embodiments within the scope of the invention.

What is claimed is:

1. A power supply device comprising:

an output terminal;

output means for supplying an output current to a load connected to the output terminal;

output voltage detection means for detecting an output voltage at the output terminal;

output control means for controlling the output means in accordance with a result of detection by the output voltage detection means so as to keep the output voltage at a predetermined value;

first means for outputting a monitoring current that varies in an identical manner with the output current;

second means for feeding, when a value of the monitoring current output from the first means is higher than a predetermined value, an output current control signal to the output control means in order to instruct the output control means to reduce a value of the output current in such a way that, the higher the value of the monitoring current, the lower the value of the output current; and a capacitive element connected between an input terminal of the second means and the output terminal.

2. A power supply device as claimed in claim 1, wherein the second means comprises:

a current-to-voltage conversion circuit for converting a current fed thereto into a voltage by passing the current through a diode and a resistor connected in series;

a judgment transistor receiving at an emitter thereof the voltage obtained by the current-to-voltage conversion circuit, and having a base thereof connected through a resistor to an output point of the output voltage detection means; and a current mirror circuit receiving a collector current of the judgment transistor, wherein the second means outputs as the output current control signal a current output from the current mirror circuit.

3. A power supply device as claimed in claim 1, wherein all circuit elements constituting the power supply device, except for the capacitive element, are formed inside a semiconductor chip, and the capacitive element is provided outside the semiconductor chip.

4. A power supply device as claimed in claim 3, wherein the second means comprises:

a current-to-voltage conversion circuit for converting a current fed thereto into a voltage by passing the current through a diode and a resistor connected in series;

a judgment transistor receiving at its emitter the voltage obtained by the current-to-voltage conversion circuit, and having its base connected through a resistor to an output point of the output voltage detection means; and a current mirror circuit receiving a collector current of the judgment transistor, wherein the second means outputs as the output current control signal a current output from the current mirror circuit.

5. A power supply device as claimed in claim 4, wherein the current-to-voltage control circuit is provided outside the semiconductor chip.

6. A power supply device comprising:

an output terminal to which a load is connected;

a first transistor having a first electrode thereof connected to a direct-current supplied voltage and having a second electrode thereof connected to the output terminal;

a second transistor having a first electrode thereof connected to the direct-current supplied voltage;

at least two resistors connected in series between the second electrode of the first transistor and a fixed voltage;

an amplifier receiving at a first input terminal thereof a setting voltage, receiving at a second input terminal thereof a voltage at a node between the at least two resistors, and having an output terminal thereof connected to control electrodes of the first and second transistors, the amplifier controlling the first and second transistors in such a way as to keep the voltage at the node equal to the setting voltage;

a limiter circuit connected to a second electrode of the second transistor so that, in accordance with a current fed from the second electrode of the second transistor, the limiter controls, through the amplifier, an output current of the first transistor; and a capacitor connected between the second electrodes of the first and second transistors.

7. A power supply device as claimed in claim 6, wherein the limiter circuit operates in such a way that, as a voltage at the second terminal of the second transistor becomes higher, the output current is limited more and, as the voltage at the second terminal of the second transistor becomes lower, the output current is limited less.

* * * * *